US006239752B1

(12) United States Patent
Blanchard

(10) Patent No.: US 6,239,752 B1
(45) Date of Patent: May 29, 2001

(54) SEMICONDUCTOR CHIP PACKAGE THAT IS ALSO AN ANTENNA

(75) Inventor: Richard A. Blanchard, Los Altos, CA (US)

(73) Assignee: STMicroelectronics, Inc., Carrollton, TX (US)

( * ) Notice: Subject to any disclaimer, the term of this patent is extended or adjusted under 35 U.S.C. 154(b) by 915 days.

(21) Appl. No.: 08/749,381

(22) Filed: Nov. 6, 1996

Related U.S. Application Data

(63) Continuation of application No. 08/397,658, filed on Feb. 28, 1995, now abandoned.

(51) Int. Cl.[7] ..... H01Q 1/24
(52) U.S. Cl. ..... 343/702
(58) Field of Search ..... 343/720, 700 MS, 343/701, 702, 754, 767, 898; 257/793; 455/291, 293, 129; H01Q 23/00, 1/00

(56) References Cited

U.S. PATENT DOCUMENTS 3,523,251 * 8/1970 Halstead ..... 343/701
5,313,193 * 5/1994 Dubois et al. ..... 340/572

FOREIGN PATENT DOCUMENTS

114105 * 5/1989 (JP) ..... H01Q/23/00
311605 * 12/1989 (JP) ..... H01Q/23/00

OTHER PUBLICATIONS

Microwave Journal, Sep. 1988, p. 252, Advertisement for NEC HJ FET's.*

* cited by examiner

*Primary Examiner*—Michael C. Wimer
(74) *Attorney, Agent, or Firm*—Theodore E. Galanthay; Lisa K. Jorgenson; Peter J. Thoma

(57) ABSTRACT

An integrated antenna structure wherein a metallic RF antenna provides part of the package structure for an RF transmit/receive chip. The requirement for a separate package to house the driver chip as well as for the wire or cable between the driver chip and the antenna are eliminated. The antenna itself provides a convenient heat sink. This arrangement is particularly attractive at UHF frequencies.

20 Claims, 1 Drawing Sheet

SEMICONDUCTOR CHIP PACKAGE THAT IS ALSO AN ANTENNA

This application is a continuation of application Ser. No. 08/397,658, filed Feb. 28, 1995, now abandoned.

BACKGROUND AND SUMMARY OF THE INVENTION

The present invention relates to integrated circuit packaging, and particularly to packaging of integrated circuits which are capable of RF transmission or reception.

As integrated circuit technology advances, the maximum frequency imposed by the technology is continually increasing. Even without the use of III–V technology, ordinary silicon technology can routinely achieve switching times of well under ten nanoseconds in simple CMOS configurations. By using differential circuitry, and/or biasing which increases the level of static power consumption, higher frequencies of operation can be achieved. Using bipolar process technology, high frequency unity-gain cutoff limits far above 1 GHz can easily be achieved. Some published results have reported unity-gain frequencies ($f_T$) in excess of 10 GHz with silicon technology.

Wireless communications requires an antenna to transmit and receive signals in the form of electromagnetic radiation. The antenna is driven by a discrete device or an integrated circuit. This "driver" chip is typically located in a package on a PC board along with other electronic circuitry. The signal from the driver chip reaches the antenna through a wire or cable.

Integrated Circuits with Wireless RF Interface

Many applications are attractive for RF interfaces from integrated circuits, particularly for low power RF interfaces. Traditional examples of such applications are keyless-entry automobile security systems, secure identification badges, antitheft devices, etc. Also, a sufficiently cheap and reliable micropower RF technology could replace the infrared LEDs which are currently used to provide a remote control capability in many consumer devices. More recently localized RF data communications between computing devices have become an area of considerable interest. Another area of interest is localized wireless voice communications, e.g. in cordless telephones and baby monitors. Another area of interest (and a very large market indeed) is cellular telephones (including the newer mobile communications services just being opened up in the United States).

In such applications, a small antenna is typically designed into the module to provide the RF coupling.

Background: Antenna Technology

Antenna technology is one of the most important branches of RF technology. At the same time, it poses unique analytical challenges, since RF problems often require detailed solutions of Maxwell's Equations with numerous constraints to achieve the needed near-field analysis. A vast amount of literature has been published in this area; see e.g. the *HANDBOOK OF ANTENNAS* (1st ed. Jasik 1961; 2nd ed. Johnson and Jasik; 3rd ed. 1994), all of which are hereby incorporated by reference. Good introductory reference material may be found in the various editions of the *ARRL's ANTENNA HANDBOOK* and *VHF HANDBOOK*, all of which are hereby incorporated by reference.

In general, as frequencies are increased, the typical size of an antenna element can be reduced for a given degree of directionality. Directionality can be increased by making the antenna physically larger.

Microwave Packaging Technology

At microwave frequencies (3 GHz and above), waveguides are frequently used for signal routing (since many dielectric materials are lossy at microwave frequencies, and since waveguides totally avoid radiation losses). To launch a signal into a waveguide (or extract a signal from the waveguide), a very simple inductive or capacitive probe is normally sufficient. For coupling to the RF signal in the waveguide, solid-state microwave devices have therefore sometimes been positioned inside the waveguide.

Innovative Compact Antenna Technology

The present invention takes integration one level higher. In the present invention, a metallic RF antenna is used as part of the integrated circuit package. This approach provides additional compactness, and exploits the high frequency capabilities of contemporary integrated circuits.

In this invention, the antenna serves as the package for the semiconductor driver chip. The requirement for a separate package to house the driver chip as well as for the wire or cable between the driver chip and the antenna are eliminated. When the back surface of the driver chip is an active terminal of the driver chip, the need for a separate load to that region may also be eliminated.

The antenna can also serve as a heat sink to dissipate power generated in the driver chip. If the driver chip is enclosed by the antenna, unwanted electromagnetic radiation can also be reduced or eliminated.

One class of embodiments uses the antenna both for RF coupling and also as a heat sink for the integrated circuit. This provides a synergy between two requirements of coupling integrated circuits to the outside world which had heretofore been considered separately.

This invention is particularly advantageous at VHF and UHF frequencies. At lower frequencies, it is more difficult to get a reasonable electrical cross-section in an antenna of reasonable size, whereas at higher frequencies it is more difficult to avoid strong (and sometimes unpredictable) directional patterns.

BRIEF DESCRIPTION OF THE DRAWING

The disclosed inventions will be described with reference to the accompanying drawings, which show important sample embodiments of the invention and which are incorporated in the specification hereof by reference, wherein.

DETAILED DESCRIPTION OF THE PREFERRED EMBODIMENTS

Figure 1A:
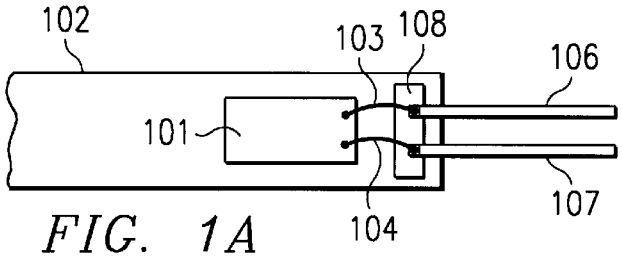
FIG. 1A is a top view.
Figure 1B:
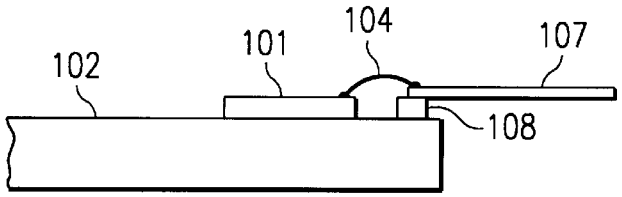
FIG. 1B is a side view, of an antenna with a driver chip mounted on its exterior.

The numerous innovative teachings of the present application will be described with particular reference to the presently preferred embodiment (by way of example, and not of limitation), in which:

FIGS. 1A and 1B show an antenna 102 with a driver chip 101 mounted on its exterior. Of course, numerous architectures may be used for the chip 101, in accordance with the various functions described above.

Similarly, various device and circuit implementations can be used for the driver circuit in the output stage of chip 101; one embodiment which is contemplated as particularly advantageous is the double-differential driver configuration described in copending application Ser. No. 08/366,793 filed Dec. 30, 1994, entitled "Differential High Speed Inductive Driver with a Bidirectional Current Limiting Output Stage", which is hereby incorporated by reference. However, many other CMOS, VDMOS, or bipolar output stage configurations can be used instead, depending on the power and frequency requirements.

Various connection schemes can be used to provide the chip with its necessary input and output connections. The scheme shown only illustrates two leads 103 and 104 (for simplicity), but of course more would normally be used; the chip must receive power, ground, and signal inputs, and must provide an RF output. (However, the power connection can be combined with the signal input or RF output.) In the configuration shown, a ground connection would also normally be provided at some other point on the antenna.

Depending on the connection scheme and the antenna connection configuration, it may be desirable to use a soldered connection between the chip and the antenna, or it may be desirable to use an insulating connection. If an insulating connection is necessary, this can be accomplished in a variety of known ways, e.g. with a diamond or beryllia or alumina sliver between the chip and the antenna.

Of course, the antenna 102 does not have to be the only relevant antenna portion. As is well known to those skilled in the art of antenna design, inductive and/or capacitive coupling to other elements may have a large effect on the Q and directionality of the antenna. Moreover, discrete reactive elements may be connected, by inductive and/or capacitive coupling, to affect the resonant frequency of the antenna.

Figure 1C:
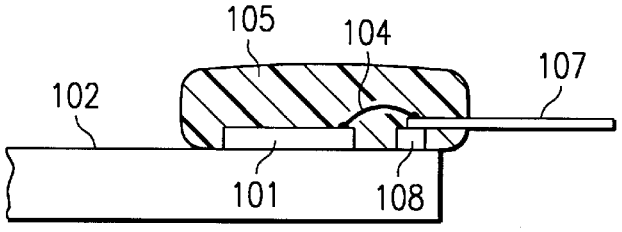
FIG. 1C is a side view of the antenna/chip combination of FIG. 1 after encapsulation.

FIG. 1C is a side view of the antenna/chip combination of FIG. 1 after encapsulation with epoxy material 105. The constraints on encapsulation in this architecture are very similar to those in power packages where a metal plate underlies the integrated circuit die, and similar techniques can be used to promote adhesion. Leads 106 and 107 extend outside the epoxy material 105 and are connected to respective interior leads 103 and 104 within the epoxy. The leads 106 and 107 are separated from the antenna by a suitable insulator 108. Thus, the epoxy material 105 and the antenna 102 together provide complete encapsulation of the chip 101 therewithin.

Figure 2A:
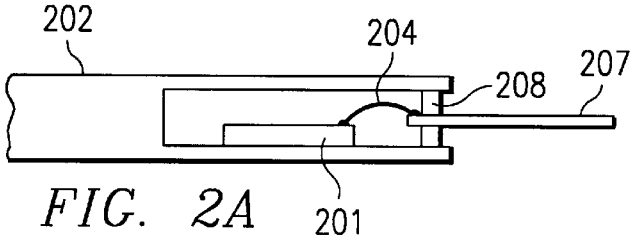
FIG. 2A is a side view of an antenna with a driver chip mounted in its interior.

FIG. 2A is a side view of another embodiment of the invention wherein similar numerals designate similar parts. The driver chip 201 is mounted in an interior cavity of the antenna 202. This has the advantage of avoiding exposure to stray electromagnetic radiation, and also provides robust physical protection for the chip.

Figure 2B:
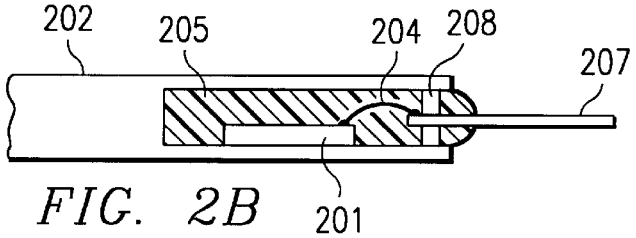
FIG. 2B is a side view of the antenna/chip combination of FIG. 2A after encapsulation.

FIG. 2B is a side view of the antenna/chip combination of FIG. 2A after encapsulation of the chip 201 in the cavity with epoxy material 205. Internal lead 204 is connected to external lead 207 at a point within the epoxy-filled cavity. Insulator 208 electrically isolates lead 207 from the antenna 202. Various techniques can be used to mount a chip inside a cavity. For example, the cavity may be designed as a two-piece metal assembly which is glued or soldered shut after the chip is in place. For another example, the cavity may be designed as a hinged metal assembly which is glued or soldered shut after the chip is in place. For another example, the cavity itself can be internally shaped to provide a wedging action which provides downward force on the chip during mounting and potting. For another example, a hole can be provided in the antenna over the die attach site, so a pusher stick can be used to provide downward force on the chip for mounting the chip and for stabilizing it during potting (and the hole left would be refilled after the pusher was withdrawn). To avoid voids during potting, a small vent/fill hole can be added at the end of the cavity.

According to the present invention, there is provided: an integrated active antenna structure, comprising: an antenna which operates at an RF operating frequency; and a monolithic solid-state amplifying device which is physically mounted to the antenna, and which is encapsulated to the antenna, and which is connected to apply an RF drive signal to the antenna.

According to the present invention, there is provided: an integrated active antenna structure, comprising: a metallic antenna which operates at an RF operating frequency; and a monolithic solid-state amplifying device which has a back surface physically mounted to the antenna, and which is encapsulated to the antenna, and which is connected to apply an RF drive signal to the antenna.

According to the present invention, there is provided: an integrated active antenna structure, comprising: antenna which operates at an RF operating frequency; and which includes a cavity therein; and a monolithic solid-state amplifying device which is physically mounted to the antenna inside the cavity, and which is encapsulated to the antenna, and which is connected to apply an RF drive signal to the antenna.

According to the present invention, there is provided: method for operating an antenna, comprising the steps of: providing antenna which operates at an RF operating frequency; range, and which includes a monolithic solid-state amplifying device which is physically mounted to the antenna, and which is encapsulated in part by the antenna; in transmit mode, selectably providing RF drive from the device to the antenna; and in receive mode, selectably amplifying RF signals on the antenna, using the device.

Modifications and Variations

As will be recognized by those skilled in the art, the innovative concepts described in the present application can be modified and varied over a tremendous range of applications, and accordingly the scope of patented subject matter is not limited by any of the specific exemplary teachings given.

For example, the antenna can optionally be designed to be resonant at the operating frequencies. This approach will provide higher voltage on the antenna (possibly much higher, depending on Q). When a high-Q resonant antenna is used, a built-in RF transformer is preferably used too. For example, the antenna shown may be a small low-Q antenna which is inductively coupled, in an RF transformer configuration, to a resonant antenna in the antenna/chip combination. This achieves a transformer relation, so that the antenna/chip combination can provide increased effective cross-section (due to the resonance) while avoiding high voltages on the chip. This also has the potential to avoid any external exposure of the antenna/chip combination, thus minimizing risk of electrostatic discharge.

In one contemplated alternative embodiment, the antenna/chip combination combination is replicated to form a two-element combined antenna, with the two chips connected to drive their respective antenna elements in phase opposition. This provides high efficiency while minimizing the routing of RF currents through inductive wires. In a further variation of this, more than one such actively driven integrated element can be used, with appropriate phasing relationships to achieve the desired degree of directionality.

As will be obvious to those skilled in the art of antenna design, passive antenna elements and/or distributed or lumped reactances can be added as desired to change the radiation pattern or Q of the antenna.

It is also alternatively possible to include more than one integrated circuit in a single antenna element to provide differential drives at physically remote locations thereof.

While the antenna element has been illustrated as a single rigid rod which is driven at one end thereof, it is also alternatively possible to use many other configurations of antenna element.

A variety of other conventional RF circuit construction techniques can be used to provide modified implementations. For example, inductive loading elements (such as ferrite beads) can be used to provide isolation of the RF signals from the power leads.

The signal input to the chip 101 does not have to be electrical, but can optionally be optical instead.

For another example, the chip 101 does not strictly have to be connected to amplify an input, but instead can optionally include on-chip signal generation logic which defines a desired modulated or encoded signal structure. Such a configuration would be unsuited for many applications, but may be advantageous for applications such as locator or self-identification beacons, distress signals, or transponders.

For another example, the chip 101 does not have to have a high level of integration, but can optionally be a simple RF driver device.

It should also be noted that the foregoing discussion has emphasized transmission operations for simplicity; but of course (under well-known principles of reciprocity) essentially the same considerations apply to reception. Thus the disclosed antenna/chip combination normally provides a transmit/receive structure, not just a transmitter structure.

In a further alternative class of embodiments, it is also possible to mount more than one chip in the same general area of the antenna. Thus, for example, in place of the chip 101, the antenna's mounting area might include more than one of the following: III–V front end chip for upconverting or downconverting amplification; silicon IC for DSP; silicon analog circuits for transmit and/or receive amplification; and/or a SAW device, on a piezoelectric substrate, for comb filtering or other RF or IF filter functions.

What is claimed is:

1. An integrated active antenna structure, comprising:

an antenna which operates at an RF operating frequency, said antenna having walls defining a cavity, an opening leading to said cavity, and an interior mounting surface within said cavity;

a semiconductor integrated circuit chip which is physically mounted on the interior mounting surface of said antenna, and which is connected to apply an RF drive signal to said antenna, the dimensions of said chip being small enough to permit installation thereof within said cavity by passing said chip through said opening;

material encapsulating said chip within said cavity; and leads insulated from said antenna and electrically connected to said chip within said cavity, said leads extending outside said cavity through said opening to provide external electrical connection to said chip.

2. The integrated antenna structure of claim 1, wherein said chip is formed in a monolithic silicon substrate.

3. The integrated antenna structure of claim 1, wherein said antenna has a Q of less than three at the RF operating frequency.

4. The integrated antenna structure of claim 1, wherein said antenna is a rigid body of metal.

5. The integrated antenna structure of claim 1, wherein the RF operating frequency is in the range between 300 MHz and 3000 MHz.

6. The integrated antenna structure of claim 1, wherein said antenna is metal and said chip is soldered thereto to provide direct electrical connection between said chip and said antenna.

7. The integrated antenna structure of claim 1, wherein the RF operating frequency is in the range between 30 MHz and 3000 MHz.

8. An integrated active antenna structure, comprising:

a metallic antenna which operates at an RF operating frequency, said antenna having walls defining a cavity, an opening leading to said cavity, and an interior mounting surface within said cavity;

a semiconductor integrated circuit chip which has a back surface physically mounted on and electrically connected to the interior mounting surface of said antenna, said chip being connected to apply an RF drive signal to said antenna through said back surface connection;

material encapsulating said chip within said cavity; and leads insulated from said antenna and electrically connected to said chip within said cavity, said leads extending outside said cavity through said opening to provide external electrical connection to said chip.

9. The integrated antenna structure of claim 8, wherein said chip is formed in a monolithic silicon substrate.

10. The integrated antenna structure of claim 8, wherein said antenna has a Q of less than three at the RF operating frequency.

11. The integrated antenna structure of claim 8, wherein said antenna is a rigid body of metal.

12. The integrated antenna structure of claim 8, wherein the RF operating frequency is in the range between 300 MHz and 3000 MHz.

13. The integrated antenna structure of claim 8, wherein the RF operating frequency is in the range between 30 MHz and 3000 MHz.

14. An integrated active antenna structure, comprising:

an elongated antenna which operates at an RF operating frequency, said antenna having walls defining a cavity, an opening leading to said cavity, and an interior mounting surface within said cavity, said opening being disposed at a longitudinal end of said antenna;

a semiconductor integrated circuit chip which is physically mounted on the interior mounting surface of said antenna inside said cavity, and which is connected to apply an RF drive signal to said antenna;

a body of epoxy material disposed in said opening and filling said cavity to entirely encapsulate said chip within said cavity; and leads insulated from said antenna and electrically connected to said chip within said cavity, said leads extending through said opening outside said body of epoxy material to provide external electrical connection to said chip.

15. The integrated antenna structure of claim 14, wherein said chip is formed in a monolithic silicon substrate.

16. The integrated antenna structure of claim 14, wherein said antenna has a Q of less than three at the RF operating frequency.

17. The integrated antenna structure of claim 14, wherein said antenna is a rigid body of metal.

18. The integrated antenna structure of claim 14, wherein the RF operating frequency is in the range between 300 MHz and 3000 MHz.

19. The integrated antenna structure of claim 14, wherein said antenna is metal and said chip is soldered thereto to provide direct electrical connection between said chip and said antenna.

20. The integrated antenna structure of claim 14, wherein the RF operating frequency is in the range between 30 MHz and 3000 MHz.

* * * * *